United States Patent [19]

Grosse

[11] Patent Number: 4,901,460

[45] Date of Patent: Feb. 20, 1990

[54] DISPLAY DEVICE

[75] Inventor: Maurice Grosse, London, United Kingdom

[73] Assignee: Jewell Poster Machines Limited, United Kingdom

[21] Appl. No.: 178,146

[22] Filed: Apr. 6, 1988

[30] Foreign Application Priority Data

Apr. 16, 1987 [GB] United Kingdom ..... 8709196

[51] Int. Cl.[4] ..... G09F 11/00

[52] U.S. Cl. ..... 40/476

[58] Field of Search ..... 40/476, 511, 500, 464, 40/617, 603, 604, 471, 472; 200/61.14, 33 R

[56] References Cited

U.S. PATENT DOCUMENTS

| | | | |
|---|---|---|---|
| 2,326,179 | 8/1943 | Sneed | 40/476 |
| 2,395,947 | 3/1946 | Walker | 40/476 |
| 2,729,007 | 1/1956 | Littman | 40/476 |
| 3,568,345 | 3/1971 | Grosse | 40/476 |

*Primary Examiner*—John J. Wilson
*Assistant Examiner*—Cary E. Stone
*Attorney, Agent, or Firm*—Laff, Whitesel, Conte & Saret

[57] ABSTRACT

A display device for displaying a number of indicia one after another has shaped guide plates (44) to positively guide the suspension rods (4) of viewing sheets (3) around a roller (8) when each suspension rod (4) is engaged by cradles (11). A strap (50) that is rendered resilient by the inclusion therein of a spring (53) extends centrally down the rear of the device and prevents successive suspension rods (4) from becoming detached from the cradles (11) in this region. A gate is provided at the foot of ramps (5) upon which the rods (4) are stacked to ensure that the rods will not become bunched or otherwise entangled on the ramps (5) and that the cradles (11) will positively pick up only one suspension rod (4) at each passage past the gate. A time delay switch (56) is associated with a microswitch (41) and will close to bypass the switch (41), after a predetermined interval of time, so that the drive of the device may re-start even if the power supply to the device had previously been switched off with the microswitch (41) in its open circuit position. Each rectangular display sheet (3) preferably comprises two layers which are secured to one another at the edges which coincide with the suspension rods (4) and along one of two longitudinal edges. The other edge is open except for two relatively short portions that are joined together at its opposite ends whereby webs carrying indicia may be entered between the layers.

7 Claims, 3 Drawing Sheets

DISPLAY DEVICE

This invention relates to display devices and seeks to provide an improved form of the display device which is the subject of British patent specification No. 1221442 which is equivalent to U.S. Pat. No. 3,568,345. Display devices or poster changing machines in accordance with what is described and illustrated in the specification of British patent No. 1221442 have now been in use for a long time and, whilst they have proved to be much more reliable and generally satisfactory than display devices that were known before the introduction of ones in accordance with patent No. 1221442, the long period of usage has disclosed certain shortcomings which the present invention avoids, or at least very significantly reduces.

According to the present invention, there is provided a display device for displaying a number of indicia one after the other, said device comprising a plurality of flexible sheets for supporting indicia on their opposite sides, each said sheet including suspension means at or near its uppermost and lowermost (when vertically disposed) ends, the device also comprising a roller, a ramp for receiving said sheets in a stack with the indicia at one side of an end sheet visible to a viewer of the device, means for defining a closed path around the roller for the suspension means between opposite ends of said ramp, electrically-driven means for positively engaging the uppermost suspension means of a sheet in the viewing position and for transporting that sheet around the roller, gate means which are displaceable upon engagement thereof by said uppermost suspension means, owing to the positive engagement of the uppermost suspension means by the electrically-driven means to permit movement of said uppermost suspension means out of said path, the uppermost suspension means subsequently being the leading suspension means as regards the direction of displacement around the roller, the lowermost, and subsequently trailing, suspension means of each sheet, being unengaged by said electrically-driven engaging means, remaining in said closed path and hence reaching said ramp to place successive sheets at the opposite end of the stack, and electrically-operated mechanism for governing the length of time during which the indicia occupy the position in which they are visible to a viewer of the device, and wherein guide means for said suspension means embraces at least an upper region of said roller and is also provided in a rear region of the device relative to said viewing position.

It has been found that, after extended use, the posters or other indicia which are contained in two-layer sheets as described in specification No. 1221442, tend to become worn and excessively flexible so that, without the guidance that is now proposed, the suspension means can become disengaged from the chain-carried cradles that move them around the roller and downwardly through a rear region of the device, with the result that the machine becomes jammed and requires the attention of an operative to restore it to working order. This can also happen if the sheets and/or posters are insufficiently flexible from the outset, or become stiffened due to ageing, ultra-violet light, chemical vapours or other causes. Another operating draw back of the known machine that is overcome by a device in accordance with the present invention is that electrical means has now been incorporated to prevent the drive of the device becoming "stalled" should said drive have been switched off at an instant during which one of the travelling cradles is engaged with the operating lever of the micro-switch that is described in the specification of patent No. 1221442. Under such circumstances, in the known machine, the machine will not re-start until the cradle has been moved out of engagement with the operating lever so that, once again, the attention of an operative has been required to make the machine operate correctly. A device in accordance with the present invention has also been improved by introducing a "gate" to allow the chain-carried cradles to pick up only one suspension means at a time, thus preventing the suspension means from becoming "bunched" or otherwise entangled at the location at which the chain-carried cradles must essentially pick up only one suspension means if the machine is not to become jammed.

For a better understanding of the present invention, and to show how the same may be carried into effect, reference will now be made, by way of example, to the accompanying drawings, in which.

Figure 1:
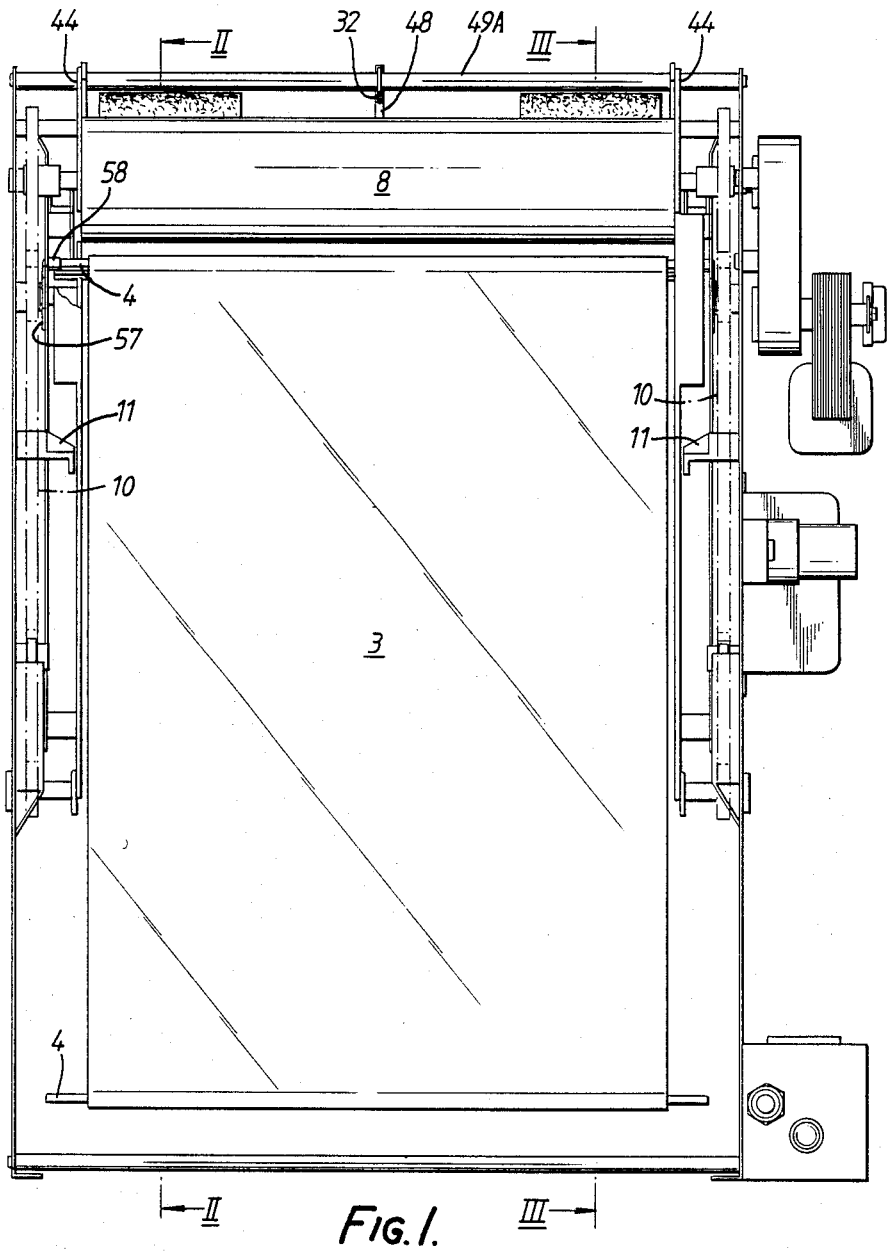
FIG. 1 is a front elevation of an improved device in accordance with the invention with an enclosing cabinet in which the device is located being ommitted.

Referring to the accompanying drawings, it is first emphasised that, since the device illustrated in the drawings is basically similar to the device illustrated in patent specification No. 1221442, only those features of the device which relate to the improvements will be described in detail whilst other features which are similar or identical to those of the known device will be described only in outline, if at all, any description or illustration that may be missing being obtainable by reference to British patent specification No. 1221442.

In accordance with an important feature of the invention, two synthetic plastics or other shaped plates 44 that extend parallel to one another and perpendicular to both the front and rear of the device are mounted towards the opposite lateral sides thereof where they will be engaged, during the use of the device, by the opposite ends of rods 4, affording suspension means, which are mounted at the alternately interchanged leading and rear ends of sheets 3 upon which the indicia to be displayed by the device is carried. Chains 10 carry cradles 11 which repeatedly engage successive suspension rods 4 and, as described in the specification of patent No. 1221442, move the sheets 3 from a viewing position at the front of the device to a position at the rear of a stack of sheets 3 in which latter position any sheet 3 is both vertically inverted and reversed, front-for-rear, as compared with the arrangement which it occupied when it was in the viewing position. As can clearly be seen in the drawings, the shaped guide plates 44 lie inwardly towards the centre of the device from their respectively neighbouring chains 10, the lower edges of the guide plates 44 having the concave shape that can be seen in FIGS. 2 and 3 of the drawings which compels any suspension rod 4 being carried around a roller 8 by the cradles 11 to stay in engagement with those cradles so that it cannot move more or less radially away from the roller 8 and must follow its appointed path from the front of the device to the rear thereof.

Each shaped guide plate 44 is co-planar with a corresponding synthetic plastics or other plate 45 whose top exhibits an upstanding front portion 46 (FIGS. 2 and 3) which co-operates with the corresponding guide plate 44 in directing any upwardly moved rod 4 into close engagement with the surface of the roller 8 and into the curved guideway there around that is formed between that roller 8 and the plates 44. Similarly, an upper rear region of each plate 45 has a somewhat larger upstanding portion 47 which is shaped to guide the cradles 11 and the suspension rods 4 which, during the use of the device, the latter carry, through a gate arrangement and downwardly at the rear of the device. The gate arrangement ensures that the leading rod 4 attached to any sheet 3 moves upwardly over the two upstanding plate portions 47 at the rear of the device whereas the rear or trailing suspension rod 4 corresponding to the same sheet 3 does not pass over the upstanding portion 47 but moves further around the roller 8 to fall into downwardly tapering throats 49 at the upper receiving ends of symmetrically similar ramps 5 in which the upper suspensions rods 4 corresponding to a stack of the sheets 3 are disposed in an inclined row.

Figure 2:
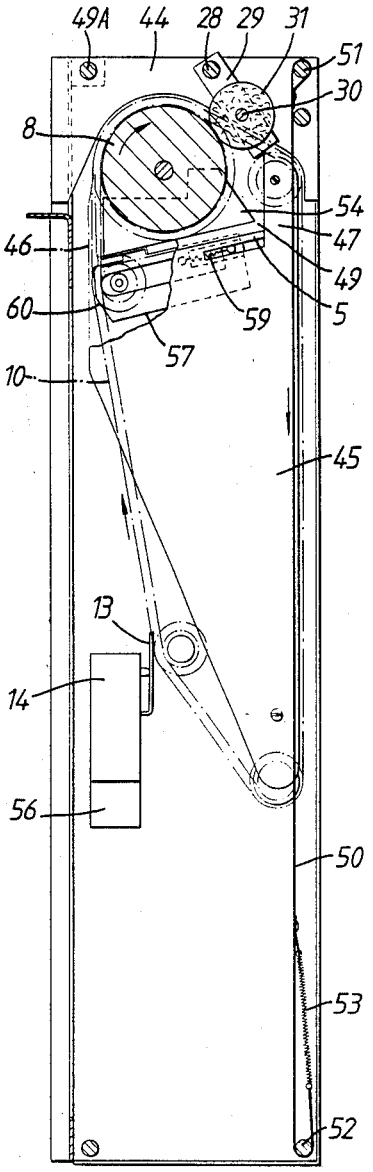
FIG. 2 is a section taken on the line II—II in FIG. 1.
Figure 3:
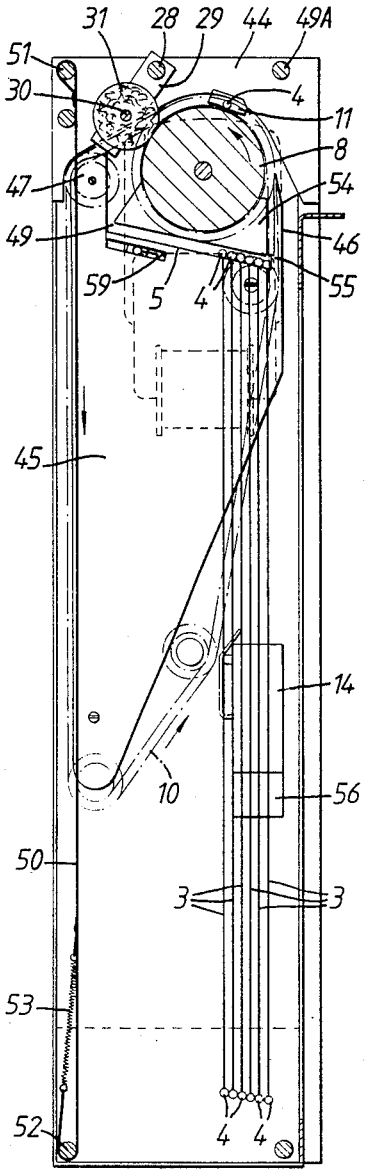
FIG. 3 is a section taken on the line III—III in FIG. 1.

The leading suspension rod 4 corresponding to any sheet 3 is engaged with the two cradles 11 carried by the two chains 10 and it is this engagement that causes said suspension rod to move rearwardly over the top of the upstanding portions 47 of the two plates 45. In so doing, the suspension rod concerned comes into engagement with two spaced but co-axial jockey rollers 31 whose common axis of rotation is afforded by a substantially horizontal shaft 30, said shaft 30 having its opposite ends non-rigidly connected to corresponding arms 29 whose upper ends are themselves angularly displaceable about a substantially horizontal shaft 28 interconnecting opposite side plates of the device. A relatively light helical tension spring 32 (FIG. 1) interconnects a bracket 48 and a fixed anchorage shaft 49A located towards the front of the device, the bracket 48 being turnable about the shaft 28 and also having the shaft 30 entered relatively rotatably through an opening therein. Thus, the relatively light spring 32 tends angularly to displace the two jockey rollers 31 about the axis of the shaft 28 in a clockwise direction as seen in FIG. 2 and in an anti-clockwise direction as seen in FIG. 3 and in both cases towards the surface of the larger diameter roller 8. The two jockey rollers 31, which may advantageously be formed from a foamed synthetic plastics material, are thus readily displaced from their illustrated positions against the action of the spring 32, when a suspension rod 4 engaged by the cradles 11 passes them but, when a "trailing" suspension rod 4 that is not engaged by the cradles 11 meets those jockey rollers 31, they are not significantly displaced and thus cause such suspension rod 4 to be directed downwardly into the two throats 49. This "gate" mechanism efficiently ensures that successive suspension rods 4 pass rearwardly over the upstanding portions 47 of the plates 45 and forwardly in front of those portions 47 into the throats 49 which lead to the ramps 5. It will be noted from FIGS. 2 and 3 of the drawings that, when the arms 29 are in the non-displaced positions that are illustrated, their lowermost free ends are very close indeed to uppermost corners of the portions 47 of the two plates 45 so that access of the opposite ends of "trailing" rods 4 to the rear of the device is positively prevented, thus avoiding the malfunction that would result if the two suspension rods 4 at the opposite ends of the same sheet 3 were both erroneously to pass by the throats 49 and rearwardly over the tops of the two plate portions 47.

The opposite ends of "leading" suspension rods 4 which are carried by the cradles 11 over the tops of the two upstanding plate portions 47 pass between convexly curved upper rear edges of those portions 47 and rearmost substantially matchingly curved concave portions of the shaped guide plates 44. In order to prevent the engaged suspension rods 4 from losing contact with the cradles 11 as those rods 4 are moved downwardly at the back of the device to take their turns as "trailing" rods which are not engaged by the cradles 11, guide means is also provided at the rear of the device and, in the embodiment which is illustrated in the drawings, this guide means takes the form of a synthetic plastics strap 50 located substantially centrally across the width of the machine with its upper end looped around a transverse anchorage rod 51 and its lowermost end looped around a similar parallel rod 52. However, the loop around the rod 52 is not a tight loop and is completed by the inclusion of a helical tension spring 53 which effectively gives the strap 50 a degree of resiliency. The device which is illustrated in the drawings is of relatively small dimensions and, in a device which is basically similar except that it has considerably greater dimensions, the rear guide means that is afforded principally by the strap 50 is omitted and is replaced by alternative rear guide means in the form of vertically extending channels carried by the opposite side plates of the device between the limbs of which inwardly facing channels the opposite ends of the suspension rods 4 are downwardly displaceable whilst being compelled not to deviate from engagement with the cradles 11 and possibly become entangled with the chains 10 or other moving parts of the device with a malfunction as the inevitable consequence.

It is important that, at the lower ends of the two inclined ramps 5, only one suspension rod 4 should be picked up as the two cradles 11 are carried upwardly therepast by the chains 10 and any "bunching", overlapping or the like of the rods 11 on the ramps 5 can cause trouble at this point and lead to jamming of the suspension rods 4 in the ramps 5 so that the suspension rods 4 are not picked up and a single picture and/or text or the like remains unchanged in the viewing position until the device is given attention. This danger is particularly prevalent in smaller machines where, naturally, the suspension rods 4 are of proportionately smaller diameter and will flex and thus become bunched or otherwise entangled more easily. This danger is initially minimised by providing metal or other plates 54 in approximately, but not necessarily exactly, co-planar relationship with corresponding ones of the two plates 45 and matching the inclination of the lower edges of the plates 54 to that of the underlying ramps 5 which latter are defined by edges of the plates 45. Provided that the perpendicular spacing between the lower edge of each plate 54 and the corresponding ramp 5 is only a little greater than is the diameter of each suspension rod 4, this usually prevents bunching or other entanglement but the spacing cannot be made too small or frictional jamming may result The residual tendency to bunching or other entanglement which remains in devices in which the suspension rods 4 are of small diameter and thus increased resiliency, can be still further reduced by providing a gate mechanism at the lower ends of the ramps 5. The relatively narrow upstanding front portion 46 of each plate 45 is formed with a step 55 and the suspension rods 4 of any sheet 3 which is in the viewing position is located just beneath the symmetrically identical steps 55 and close to the lower edges of the plates 54 which lower edges are perpendicularly bent over The arrangement is, in fact, such that an upward pressure is necessary to move the ends of a rod 4 pass the steps 55 and the adjacent ends of the extremities of the lower edges of the plates 54 and this upward pressure is, of course, given when the cradles 11 meet the ends of successive suspension rods 4 as the cradles are carried upwardly by the chains 10.

In addition, symmetrically identical metal or other plates 57 are movably mounted alongside fixed plates of the machine, each plate 57 having a perpendicular rim 58 (FIG. 1) that extends over the corresponding ends of the suspension rods 4 in the respective ramp 5 and, in particular, normally into the path of that portion of the corresponding cradle 11 which will pick up the lowermost rod 4 in the inclined stack thereof. However, each slotted plate 57 is urged by a light helical tension spring 59 towards the left as seen in FIG. 2 into the normal or undeflected position which has just been described, in which position an edge region 60 thereof lies immediately alongside the corresponding chain 10. When, during operation, that chain 10 brings the respective cradle 11 upwardly towards the rod pick-up area, part of the cradle 11 meets the edge region 60 of the plate 57 and displaces the whole plate to the right, as seen in FIG. 2, against the action of the spring 59 so that the rim 58 thereof is moved just far enough to allow a single rod end 4 to be engaged by the cradle 11 and raised past the position temporarily vacated by the end of the rim 58. As soon as the cradle 11 no longer contacts the plate edge region 60, the plate 57 is returned by the spring 59 to the position in which its rim 58 will not allow any rod end 4 to rise significantly. If desired, light blade springs may be provided instead of the plates 57 gently to press the suspension rods 4 downwardly onto the ramps 5. By employing one or the other of these additional gate mechanisms, it can be ensured that bunching or other entanglement of resilient suspension rods 4 in the region of the ramps 5 is a very rare occurence indeed.

As described in the specification of British patent No. 1221442, a micro-switch 14 is mounted in such a position that an operating lever 13 thereof is engaged by one of the cradles 11 each time it passes said lever 13 thus operating the micro-switch. The micro-switch 14 acts to release a self-holding relay forming part of the electrical/mechanical system by which a sheet 3 is held in the viewing position for an adjustable period of time and the known arrangement is quite satisfactory except when operation of the device is stopped with said cradle 11 in engagement with the operating lever 13 so that the circuit through the micro-switch 14 is broken. This can occur when, purely for example, the supply of electricity to the device is governed by a time switch or in other circumstances in which said supply is controlled by a switch remote from the device itself. Under such circumstances, the fractional horsepower electric motor of the device will not re-start and the device requires attention in this respect. To avoid this possibility, the micro-switch 14 now incorporates a time delay switch 56 that is normally in an open-circuit position but that will close to complete a circuit by-passing the micro-switch 14 in the event that the normal circuit through that micro-switch 14 remains open for more than a predetermined time that could have a value of, for example, five minutes.

Thus, should the device be switched on after a significant period of non-use and with one of the cradles 11 in engagement with the operating lever 13 so that the micro-switch 14 is in its open circuit setting, the time delay switch 56 will have closed to by-pass the circuit which is "open" through the micro-switch 14 and this allows the device to re-start and to continue normal operation thereafter because, after a few seconds at the most, the circuit through the time delay switch 56 will open and will remain open until the device is next switched off for at least, say, five minutes.

It is preferred that each sheet 3 should, in fact, be in the form of a synthetic plastics or other transparent holder that is closed along both the edges thereof that abut its two suspension rods 4 and also along one vertical (when the sheet 3 concerned is in the viewing position) edge, this leaving the opposite vertical edge open for the insertion and removal of paper, plastics or other flexible webs upon which pictures and/or text and/or other indicia will appear. It will be appreciated that both opposite sides of each sheet 3 can thus show display material and that, as described in British patent specification No. 1221442, the display material at one side should be inverted relative to the display material at the other side to ensure that the material is viewed in the correct "upright" position whichever side thereof is disposed in the viewing position in the device. The arrangement which has just been described enables the display webs quickly and easily to be entered between, or removed from between, the two layers of each sheet 3 and, even after long periods of use, an absolute minimum of fraying occurs. If considered necessary, the "open" vertical edge of each sheet 3, between its two layers, may be closed for a short distance at its uppermost and lowermost ends. This enables two back-to-back display webs of the correct size to be entered through the large gap between the two relatively short closed portions of said edge by effecting some flexing of the webs whereafter the short closed portions of said edge will prevent the webs moving laterally out from between the two layers of the sheet 3.

In a relatively large machine in accordance with the invention, problems associated with the flexibility of the rods 4 rarely occur because those rods are thicker and more rigid in such a machine. However, the weight of these rods 4 can, in time, cause them to start to tear away from the sheets 3 and this can be prevented, or postponed for a long time, by interconnecting the two rods 4 corresponding to each two-layered sheet 3 by two flexible but inextensible woven plastics tapes or the like, the tapes being located at, or close to, the edges of each sheet 3 which are vertical in the viewing position, and being substantially invisibly located between the two layers and between the paper or other display webs or the like sandwiched inside the sheet 3. The tapes or the like relieve the sheets 3 of the stretching forces which can be quite high when the rods 4 are of relatively heavy construction.

Figure 4:
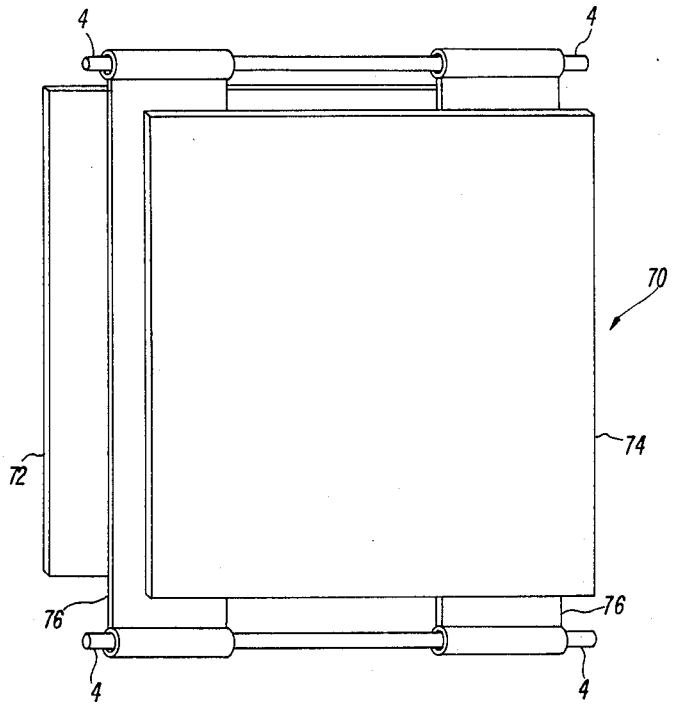
FIG. 4 is an exploded view, in perspective, of a flexible sheet comprising and inextensible member having two transparent layers on the opposite sides thereof.
Figure 5:
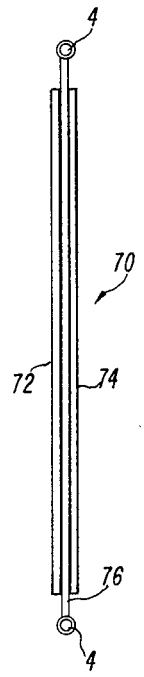
FIG. 5 is an edge view of the sheet of FIG. 4.

As best seen in FIGS. 4, 5, the display device 70 may include two opposing transparent layers 72, 74 interconnected by a flexible, but inextensible member 76 which is located between the two layers 72, 74. Member 76 relives the layers 72, 74 of all stretching forces.

What I claim is:

1. A display device for displaying a number of indicia one after the other, said device comprising a plurality of flexible sheets for supporting indicia on their opposite sides, each of said sheets including suspension means at or near its uppermost and lowermost when vertically disposed ends, the device also comprising a roller, a ramp for receiving said sheets in a stack with the indicia at one side of an end sheet visible to a viewer of the device, means for defining a closed path around the roller for the suspension means between opposite ends of said ramp, electrically-driven means for positively engaging the uppermost suspension means of a sheet in the viewing position and for transporting that sheet around the roller, gate means which are displaceable upon engagement thereof by said uppermost suspension means, owing to the positive engagement of the uppermost suspension means by the electrically-driven means to permit movement of said uppermost suspension means out of said path, the uppermost suspension means subsequently being the leading suspension means as regards the direction of displacement around the roller, the lowermost, and subsequently trailing, suspension means of each sheet, being unengaged by said electrically-driven engaging means, remaining in said closed path and hence reaching said ramp to place successive sheets at the opposite end of the stack, and electrically-operated mechanism for governing the length of time during which the indicia occupy the position in which they are visible to a viewer of the device, and wherein guide means for said suspension means embraces at least an upper region of said roller and is also provided in a rear region of the device relative to said viewing position, the guide means provided in a rear region of the device relative to said viewing position comprising a substantially vertically extending strap.

2. A display device according to claim 1, wherein said strap is located substantially mid-way between opposite side plates of the device.

3. A display device according to claim 2, wherein one end of said strap is connected to a support by way of a closed loop which loop includes spring means arranged to render the strap resiliently deflectable against the action of that spring means.

4. A display device for displaying a number of indicia one after the other, said device comprising a plurality of flexible sheets for supporting indicia on their opposite sides, each of said sheets including suspension means at or near its uppermost and lowermost when vertically disposed ends, the device also comprising a roller, a ramp for receiving said sheets in a stack with the indicia at one side of an end sheet being visible to a viewer of the device, means for defining a closed path around the roller for the suspension means between opposite ends of said ramp, electrically-driven means for positively engaging the uppermost suspension means of a sheet in the viewing position and for transporting that sheet around the roller, gate means which are displaceable upon engagement thereof by said uppermost suspension means, owing to the positive engagement of the uppermost suspension means by the electrically-driven means to permit movement of said uppermost suspension means out of said path, the uppermost suspension means subsequently being the leading suspension means as regards the direction of displacement around the roller, the lowermost, and subsequently trailing, suspension means of each sheet, being unengaged by said electrically-driven engaging means, remaining in said closed path and hence reaching said ramp to place successive sheets at the opposite end of the stack, and electrically-operated mechanism for governing the length of time during which the indicia occupy the position in which they are visible to a viewer of the device, wherein guide means for said suspension means embraces at least an upper region of said roller and is also provided in a rear region of the device relative to said viewing position, said ramp having a foot, and a gate mechanism at the foot of said ramp to ensure that only a single one of said suspension means shall be positively engaged by the electrically-driven means for transporting the corresponding sheet around the roller.

5. A display device according to claim 4, wherein said gate mechanism includes rimmed plates temporarily displaceable by the passage therepast of the electrically-driven means for positively engaging the uppermost suspension means of successive sheets.

6. A display device for displaying a number of indicia one after the other, said device comprising a plurality of flexible sheets for supporting indicia on their opposite sides, each of said sheets including suspension means at or near its uppermost and lowermost when vertically disposed ends, the device also comprising a roller, a ramp for receiving said sheets in a stack with the indicia at one side of an end sheet visible to a viewer of the device, means for defining a closed path around the roller for the suspension means between opposite ends of said ramp, electrically-driven means for positively engaging the uppermost suspension means of a sheet in the viewing position and for transporting that sheet around the roller, gate means which are displaceable upon engagement thereof by said uppermost suspension means, owing to the positive engagement of the uppermost suspension means by the electrically-driven means to permit movement of said uppermost suspension means out of said path, the uppermost suspension means subsequently being the leading suspension means as regards the direction of displacement around the roller, the lowermost, and subsequently trailing, suspension means of each sheet, being unengaged by said electrically-driven engaging means, remaining in said closed path and hence reaching said ramp to plate successive sheets at the opposite end of the stack, and electrically-operated mechanism for governing the length of time during which the indicia occupy the position in which they are visible to a viewer of the device, wherein guide means for said suspension means embraces at least an upper region of said roller and is also provided in a rear region of the device relative to said viewing position, the electrically-operated mechanism for governing the length of time during which the indicia occupies the position in which they are visible to a viewer of the device including a microswitch openable by the passage therepast of the electrically-driven means for positively engaging the uppermost suspension means of successive sheets, and said microswitch being associated with a time delay switch arranged to bypass the microswitch should the latter remains in an open circuit position for more than a predetermined interval of time, whereby the device will re-start should its source of electrically power be switched off with the microswitch in its open circuit position.

7. A display device for displaying a number of indicia one after the other, said device comprising a plurality of flexible sheets for supporting indicia on their opposite sides, each flexible sheet of the device comprising two transparent layers, each of said sheets including suspension means at or near its uppermost and lowermost when vertically disposed ends, the corresponding suspension means being directly interconnected by flexible but inextensible members located between the two layers and arranged substantially to relieve the sheet of stretching forces, the device also comprising a roller, a ramp for receiving said sheets in a stack with the indicia at one side of an end sheet visible to a viewer of the device, means for defining a closed path around the roller for the suspension means between opposite ends of said ramp, electrically-driven means for positively engaging the uppermost suspension means of a sheet in the viewing position and for transporting that sheet around the roller, gate means which are displaceable upon engagement thereof by said uppermost suspension means, owing to the positive engagement of the uppermost suspension means by the electrically-driven means to permit movement of said uppermost suspension means out of said path, the uppermost suspension means subsequently being the leading suspension means as regards the direction of displacement around the roller, the lowermost, and subsequently trailing, suspension means of each sheet, being unengaged by said electrically driven engaging means, remaining in said closed path and hence reaching said ramp to place successive sheets at the opposite end of the stack, and electrically-operated mechanism for governing the length of time during which the indicia occupy the position in which they are visible to a viewer of the device, and wherein guide means for said suspension means embraces at least an upper region of said roller and is also provided in a rear region of the device relative to said viewing position.

* * * * *